United States Patent [19]

Stewart, Jr.

[11] Patent Number: 4,984,588

[45] Date of Patent: Jan. 15, 1991

[54] LOW DELIVERY CIGARETTE

[75] Inventor: Lawrence L. Stewart, Jr., Richmond, Va.

[73] Assignee: Philip Morris Incorporated, New York, N.Y.

[21] Appl. No.: 301,486

[22] Filed: Sep. 14, 1981

[51] Int. Cl.[5] ..... A24D 1/00; A24D 3/04

[52] U.S. Cl. ..... 131/364; 131/363; 131/361; 131/360; 131/331

[58] Field of Search ..... 131/331, 336, 337, 339, 131/344, 360, 361, 362, 363, 364

[56] References Cited

U.S. PATENT DOCUMENTS

| | | |
|---|---|---|
| 29,436 | 7/1860 | Lindsley . |
| 346,025 | 7/1886 | Cook . |
| 2,349,551 | 10/1943 | Helm . |
| 3,674,036 | 7/1970 | Vega . |
| 3,756,249 | 9/1973 | Selke et al. . |
| 3,789,855 | 2/1974 | Norman . |
| 3,800,805 | 4/1974 | Horsewell et al. . |
| 3,860,011 | 1/1975 | Norman . |
| 3,863,644 | 2/1975 | Hunt . |
| 3,905,377 | 9/1975 | Yatrides . |
| 4,027,679 | 8/1976 | Kaswan . |
| 4,109,666 | 3/1976 | Norman et al. . |
| 4,142,534 | 5/1976 | Brantl . |

FOREIGN PATENT DOCUMENTS

| | | |
|---|---|---|
| 2633263 | 7/1976 | Fed. Rep. of Germany . |
| 2712800 | 3/1977 | Fed. Rep. of Germany . |
| 2620335 | 11/1977 | Fed. Rep. of Germany . |
| 2636116 | 2/1978 | Fed. Rep. of Germany . |
| 232819 | 4/1925 | United Kingdom . |
| 1428018 | 8/1973 | United Kingdom . |

*Primary Examiner*—V. Millin

*Attorney, Agent, or Firm*—Jeffrey H. Ingerman

[57] ABSTRACT

A smoking article (10) is disclosed, in which a tube (12) of combustible, heat fusible material is surrounded by tobacco filler (14) and wrapper (16). Tube (12) extends from approximately 5 mm from the mouth end of the filter to within approximately 10 mm of the opposite end of smoking cylinder (17). By directing essentially unfiltered, undiluted smoke to the smoker during the initial puffs, tube (12) gives the impression of a stronger flavored cigarette. After the first several puffs, the tube (12) is melted shut and normal dilution occurs.

8 Claims, 2 Drawing Sheets

LOW DELIVERY CIGARETTE

BACKGROUND OF THE INVENTION

This invention relates to smoking articles in general and more particularly to a highly filtered, highly diluted cigarette, adapted to have a stronger flavor during the first several puffs.

DESCRIPTION OF THE PRIOR ART

In recent years there has been a tendency in the tobacco industry to produce tobacco products, particularly cigarettes, having filters with greater filtering efficiency and higher levels of dilution. This higher filter efficiency and greater dilution reduces the total particulate matter received by the smoker and hence reduces the flavor to some extent.

While the increased efficiency is frequently desirable, the first few puffs of a tobacco product employing a high efficiency and high dilution filter generally have very little taste or impact for the smoker. For the first few puffs, not only does the high efficiency filter act to remove a significant portion of the total particulate matter, but the entire tobacco column, to a certain extent, serves as a filter. This combination is such as to remove almost all the particulate matter so that the smoker receives little satisfaction from the first few puffs.

Another factor making the first few puffs of a highly filtered, highly diluted cigarette weaker in flavor is the fact that dilution is greatest during the first few puffs. This is due, in part, because air enters the cigarette during each puff through the porous tobacco paper wrapper, and most dilution occurs during the initial puffs when little of the tobacco rod and wrapper have been consumed. Also since resistance to draw (RTD), the pressure drop developed when air is drawn through the cigarette, is greatest at the start of the smoking cycle, and since dilution through the ventilation holes in the filter is proportional to RTD, ventilation into the filter is greatest during the initial puffs on the cigarette when RTD is greatest. A combination of these factors results in a cigarette having very weak flavor during the initial several puffs.

Prior art methods of solving this problem have met with varying degrees of success. Selke et al, U.S. Pat. No. 3,756,249, discloses a longitudinally extending tube with two or more partial obstructions to air flow which are removed as the tobacco rod is smoked. However, a tube such as this is intricate in construction and it would be difficult to assure product uniformity when producing cigarettes at the high rate used in modern cigarette manufacturing.

Another method is disclosed by British American Tobacco Company, British Patent No. 1,428,018, in which an air impermeable tube which is inserted in the filter, eventially becomes clogged during the course of smoking, in order to deliver a stronger flavor during the initial puffs. This method also is somewhat intricate and insuring product uniformity would be difficult.

It is, therefore, an object of the present invention to provide a cigarette which gives a stronger flavor during the initial puffs without using complicated systems that would be difficult to reproduce form a product uniformity standpoint, and would add significantly to manufacturing costs.

SUMMARY OF THE INVENTION

According to the present invention, the foregoing and other objects are attained by providing a smoking article with a hollow, elongated tube of a combustible, heat fusible material that extends from approximately 5 mm from the mouth end of the filter to approximately 10 mm short of the end of the tobacco segment. As the cigarette is smoked, relatively undiluted smoke enters the tube during the initial several puffs and is delivered virtually unfiltered to the smoker. After the first several puffs, the tube is melted shut and normal dilution occurs.

BRIEF DESCRIPTION OF THE DRAWINGS

A more complete appreciation of the invention and many of the attendent advantages, thereof, will be readily apparent by reference to the following detailed description when considered in connection with the accompanying drawings wherein.

DESCRIPTION OF THE PREFERRED EMBODIMENT

Figure 1:
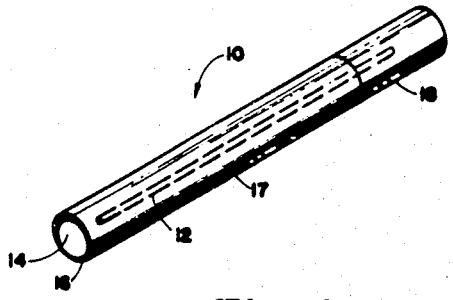
FIG. 1 is a prespective view partially in phantom of a smoking article according to the present invention.
Figure 2:
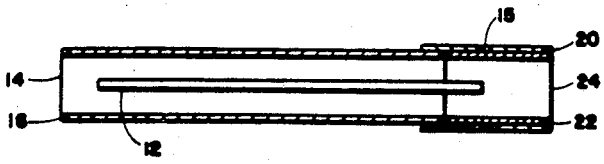
FIG. 2 is a longitudinal cross section of the invention shown in FIG. 1.

Referring now more particularly to the drawings and specifically to FIGS. 1 and 2, there is illustrated a preferred embodiment of the invention as it would be used in a smoking article, in this case a cigarette, designated generally by the numeral 10. Cigarette 10 has two major parts; smoking cylinder 17 and filter 18.

Filter element 18, which is cylindrical in shape and substantially conforms to the cross sectional size and shape of smoking cylinder 17, consists of filter material 24 and plug wrap 22. Filter material 24 may be composed of any known filtering medium or combination thereof, but in the preferred embodiment is cellulose acetate.

Filter element 18 abuts smoking cylinder 17 and is attached to smoking cylinder 17 in a conventional manner. In the preferred embodiment, filter element 18 is attached to smoking cylinder 12 by use of air impervious tipping paper 20. Ventilation holes 15 penetrate tipping paper 20 and allows ventilation air to pass through ventilation holes to porous plug wrap 22.

Hollow tube 12 is made of a heat fusible material and extends substantially the length of tobacco rod 17 and filter element 18. The primary consideration in choosing the material for hollow tube 12 is that it be heat fusible and not impart an off taste to the cigarette. In the preferred embodiment, hollow tube 12 is of hydroxypropyl cellulose and approximately 2 millimeters (mm) in diameter.

The diameter of hollow tube 12 may be from approximately 0.5 mm to 4 mm. The considerations involved in selection of tube size are that too small a tube will not pass sufficient unfiltered smoke to the smoker during the first several puffs to impact flavor and too large a tube would impart too strong a flavor during the initial several puffs. Also, too large a diameter hollow tube 12 would effect the burning characteristics of the cigarette and RTD.

During smoking, relatively unfiltered smoke is transported the length of hollow tube 12 to near the mouth end of the filter and enters the smokers mouth virtually unfiltered and undiluted. Thus, the first several puffs of the cigarette will be stronger than would otherwise be the case. As the coal nears hollow tube 12, hollow tube 12 is fused shut by the heat and no further smoke is transported the length of hollow tube 12. When the coal reaches tube 12, it is consumed and smoking of the cigarette continues in a normal manner.

Figure 3:
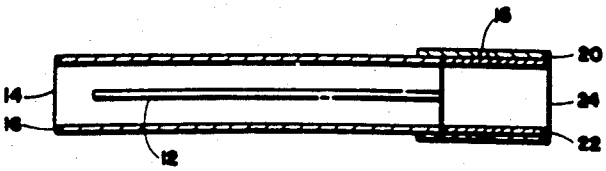
FIG. 3 is a longitudinal cross section of another embodiment of the invention.

FIG. 3 shows another embodiment of the invention wherein hollow tube 12 ends at filter element 18. This embodiment functions in a manner similar to that described above, except more filtration takes place since smoke passing through hollow tube 12 must transmit the entire length of filter material 24. However, this embodiment is easier to manufacture since the hollow tube 12 does not extend into the filter element 18.

Figure 4:
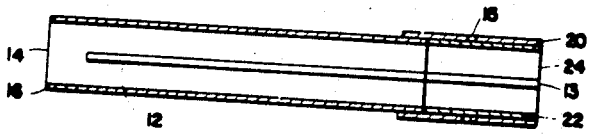
FIG. 4 is a longitudinal cross section of another embodiment of the invention.

FIG. 4 shows another embodiment of the invention wherein a hollow tube segment 13 extends the length of filter 18.

Thus, a cigarette according to the present invention imparts a stronger flavor during the first initial puffs from a highly diluted, highly filtered cigarette. Also, since the invention requires only that a thin, heat fusible tube be inserted in the cigarette the simplicity of the invention makes it easy to incorporate into todays high speed cigarette manufacturing operation.

It will be understood that the foregoing description is of the preferred embodiment of the invention only and is, therefore, merely representative. Obviously, there are many variations and modifications of the present invention in light of the above teaching that will readily apparent to those skilled in the art. For example, the hollow tube may be incorporated into a smoking cylinder which is completely unfiltered. In this case, the hollow tube would extend to within a short distance of the mouth end of the cigarette. Also, the distance of the hollow tube from the mouth end and the smoking end of the cigarette may be varied somewhat without effecting the objects of the invention. It is, therefore, understood that within the scope of the appended claims the invention may be practiced otherwise then is specifically described.

I claim:

1. A smoking article comprising:

a cylinder of smoking material;

a filter attached to said cylinder of smoking material; and a tube of heat fusible material extending from near one end of said smoking material, to the junction of said smoking material and said filter, said tube being open at both ends for conveying virtually unfiltered, undiluted smoke the length of said tube, said tube extending through the junction of said filter and said cylinder of smoking material and into said filter.

2. A smoking article as in claim 1 wherein said tube is hydroxypropyl cellulose.

3. A smoking article as in claim 1 wherein said tube is polyethylene.

4. A smoking article as in claim 1 wherein said tube extends from approximately 10 mm from the smoking end of said article to within about 5 mm from the mouth end of said smoking article.

5. A smoking article comprising:

a cylinder of smoking material;

a filter attached to said cylinder of smoking material; and

6. A smoking article as in claim 5 wherein said heat fusible tube is hydroxypropyl cellulose.

7. A smoking article as in claim 5 wherein said heat fusible tube is polyethylene.

8. A smoking article as in claim 5 wherein said heat fusible tube extends from approximately 10 mm from the smoking end of said article to said junction, and said hollow tube extends from said junction to within about 5 mm from the mouth end of said smoking article.

* * * * *

UNITED STATES PATENT AND TRADEMARK OFFICE

CERTIFICATE OF CORRECTION

PATENT NO. : 4,984,588

DATED : January 15, 1991

INVENTOR(S) : Lawrence L. Stewart, Jr.

It is certified that error appears in the above-identified patent and that said Letters Patent is hereby corrected as shown below: Item [56]

Title page, References Cited, U.S. PATENT DOCUMENTS,
"2,349,551 10/1943 Helm" should be
-- 2,349,551 5/1944 Helm --;
"3,674,036 7/1970 Vega" should be
-- 3,674,036 7/1972 Vega --;
"4,027,679 8/1976 Kaswan" should be
-- 4,027,679 6/1977 Kaswan --;
"4,109,666 3/1976 Norman et al." should be
-- 4,109,666 8/1978 Norman et al. --; and
"4,142,534 5/1976 Brantl" should be
-- 4,142,534 3/1979 Brantl --.

Title page, References Cited, FOREIGN PATENT DOCUMENTS,
"2633263 7/1976 Fed. Rep. of Germany" should be
-- 2633263 2/1977 Fed. Rep. of Germany --; and
"2712800 3/1977 Fed. Rep. of Germany" should be
-- 2712800 9/1978 Fed. Rep. of Germany --.

Column 3, line 15, "transmit" should be -- transit --.

UNITED STATES PATENT AND TRADEMARK OFFICE

CERTIFICATE OF CORRECTION

PATENT NO. : 4,984,588

DATED : January 15, 1991

INVENTOR(S) : Lawrence L. Stewart, Jr.

It is certified that error appears in the above-identified patent and that said Letters Patent is hereby corrected as shown below:

Claim 5, column 4, after line 30 should be inserted:
-- a tube of heat fusible material extending from near one end of said smoking material, to the junction of said smoking material and said filter, said tube being open at both ends for conveying virtually unfiltered, undiluted smoke the length of said tube, wherein:
said filter contains a hollow tube substantially aligned with said heat fusible tube in said smoking cylinder. --.

Signed and Sealed this

Twenty-eighth Day of September, 1993

Bruce Lehman

*Attest:*

BRUCE LEHMAN

*Attesting Officer*

*Commissioner of Patents and Trademarks*